US009235175B2

(12) United States Patent
Jeon et al.

(10) Patent No.: US 9,235,175 B2
(45) Date of Patent: Jan. 12, 2016

(54) IMAGE FIXING APPARATUS INCLUDING A FIXING BELT AND IMAGE FORMING APPARATUS HAVING THE SAME

(71) Applicant: SAMSUNG ELECTRONICS CO., LTD., Suwon-si, Gyeonggi-do (KR)

(72) Inventors: Sang Uk Jeon, Yongin-si (KR); Sun Hyung Lee, Suwon-si (KR); Ju Hyeong Lee, Busan (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/303,005

(22) Filed: Jun. 12, 2014

(65) Prior Publication Data

US 2014/0376978 A1 Dec. 25, 2014

(30) Foreign Application Priority Data

Jun. 21, 2013 (KR) ..... 10-2013-0071918

(51) Int. Cl.
*G03G 15/20* (2006.01)

(52) U.S. Cl.
CPC ..... *G03G 15/206* (2013.01); *G03G 2215/2035* (2013.01)

(58) Field of Classification Search
CPC ..... G03G 2215/2035; G03G 15/206
USPC ..... 399/329, 122, 328, 333
See application file for complete search history.

(56) References Cited

U.S. PATENT DOCUMENTS

2011/0135359 A1* 6/2011 Kikuchi et al. ..... 399/333

* cited by examiner

*Primary Examiner* — Billy Lactaoen
(74) *Attorney, Agent, or Firm* — Staas & Halsey LLP

(57) ABSTRACT

An image fixing apparatus is provided including a pressing roller, a fixing belt rotatably disposed such that an outer circumferential surface of the fixing belt contacts the pressing roller, and a rotating bush to support rotation of the fixing belt. The fixing belt includes a load support member arranged in an axial direction, a heating layer formed on an outer circumferential surface of the load support member to generate heat, and an electrode layer provided with an first portion axially contacting the heating layer at an axial end of the load support member, the electrode layer transferring electric energy to the heating layer. An inner end of the rotating bush axially extends to an inner side of the electrode layer such that the electrode layer is supported by the rotating bush. The image fixing apparatus may uniformly form a fixing nip and improve durability of the fixing belt.

17 Claims, 4 Drawing Sheets

IMAGE FIXING APPARATUS INCLUDING A FIXING BELT AND IMAGE FORMING APPARATUS HAVING THE SAME

CROSS-REFERENCE TO RELATED APPLICATIONS

This application is related to, and claims the priority benefit of, Korean Patent Application No. 10-2013-0071918, filed on Jun. 21, 2013 in the Korean Intellectual Property Office, the disclosure of which is incorporated herein by reference.

BACKGROUND

1. Field

Embodiments are related to an image fixing apparatus having enhanced durability and an image forming apparatus having the same.

2. Description of the Related Art

An image forming apparatus is an apparatus to print an image onto a printing medium. Examples of such an image forming apparatus include a printer, a copier, a facsimile machine, and a multifunction device combining two or more functions of the above-mentioned apparatuses.

In an image forming apparatus using electrophotography, an electrostatic latent image may be formed on the surface of a photosensitive body charged with a predetermined electric potential by emitting light onto the photosensitive body. Toner may be supplied onto the electrostatic latent image to form a visible image. The visible image formed on the photosensitive body may be directly transferred to a printing medium or transferred to the printing medium via an intermediate transfer member. The visible image transferred to the printing medium may be fixed to the printing medium as the printing medium passes through an image fixing apparatus.

The image fixing apparatus generally includes a fixing belt provided with a roller or a belt, and a pressing member to closely contact the fixing belt to form a fixing nip. When the printing medium having a transferred toner image is introduced into the gap between the fixing belt and the pressing member, the toner image may be fixed to the printing medium by the heat transferred to the fixing belt and the pressure applied at the fixing nip.

In determining the quality of an image printed onto a printing medium, gloss and gloss uniformity of a printing medium with a fixed toner image may be important factors. To achieve high gloss and gloss uniformity, high fixing pressure may need to be applied around the fixing nip formed between the fixing belt and the pressing member, and a uniform width of the fixing nip may need to be provided and maintained.

SUMMARY

It is an aspect of an embodiment to provide an image fixing apparatus that may uniformly form a fixing nip between a fixing belt and a pressing member and improve durability of constituents, and an image forming apparatus having the same.

Additional aspects are forth in part in the description which follows and, in part, are obvious from the description, or may be learned from practice of the invention.

In accordance with an aspect of an embodiment, an image fixing apparatus includes a pressing roller arranged to rotate, a fixing belt arranged to rotate about an axis and disposed such that an outer circumferential surface of the fixing belt contacts the pressing roller, and a rotating bush arranged at opposite ends of the fixing belt to support rotation of the fixing belt, wherein the fixing belt includes a load support member arranged in an axial direction, a heating layer formed on at least one portion of an outer circumferential surface of the load support member to generate heat by receiving electric energy, and an electrode layer provided with an first portion axially contacting an end of the heating layer at an axial end of the load support member, the electrode layer transferring electric energy to the heating layer, wherein an inner end of the rotating bush axially extends to an inner side of the electrode layer such that the electrode layer is supported by the rotating bush.

The inner end of the rotating bush axially may extend to an inner side of the first portion such that the first portion is supported by the rotating bush.

An end of the pressing roller may axially extend to an outer side of the first portion such that the first portion is supported by the pressing roller.

The pressing roller may extend a shorter length from an axially central portion of the fixing belt toward ends of the fixing belt than the heating layer.

A distance between an end of the pressing roller and a corresponding end of the heating layer in an axial direction of the fixing belt may be equal to or greater than 4 mm.

The heating layer may surround a second portion forming at least one portion of an outer circumferential surface of the electrode layer.

The first portion and at least one part of the second portion of the electrode layer may be allowed to contact the heating layer by Ag paste.

A third portion of the electrode layer rather than the first portion and the second portion may not contact the heating layer, but contacts a power supply brush to transfer electric energy to the heating layer.

The fixing belt may include a release layer arranged on an outer circumferential surface of the heating layer to contact the pressing roller.

The heating layer may include a carbon nanotube.

In accordance with an aspect of an embodiment, an image fixing apparatus includes a pressing roller arranged to rotate, a fixing belt having a hollow portion and disposed such that an outer circumferential surface of the fixing belt contacts the pressing roller, and a rotating bush having at least one part inserted into the hollow portion and adapted to support rotation of the fixing belt, wherein the fixing belt includes a load support member having an axial hollow portion, a heating layer formed on at least one part of an outer circumferential surface of the load support member to generate heat when receiving electric energy supplied thereto, an electrode layer provided with a first portion axially contacting the heating layer at an axial end of the load support member and a second portion forming at least one part of an outer circumferential surface of the electrode layer and surrounded by heating layer, the electrode layer transferring electric energy to the heating layer, wherein a distance (C) from an axially central portion of the fixing belt to an end of the heating layer, a distance (P) from the axially central portion of the fixing belt to an end of the pressing roller, a distance (N) from the axially central portion of the fixing belt to the first portion, and a distance (B) from the axially central portion of the fixing belt to an end of the rotating bush satisfy a relationship of $C>P>N>B$.

The fixing belt may include a release layer arranged on an outermost surface of the fixing belt and disposed to contact the pressing roller.

The heating layer may include a carbon nanotube.

The electrode layer may contact a power supply brush externally supplying electric energy and include a third portion, an outer circumferential surface of the third portion being exposed to an outside of the outer circumferential surface.

The distance (C) from the axially central portion of the fixing belt to the end of the heating layer may be greater than the distance (P) from the axially central portion of the fixing belt to the end of the pressing roller by 4 mm or more.

In accordance with an aspect of an embodiment, an image forming apparatus includes a printing unit to form an image on a printing medium, and an image fixing apparatus to fix the image to the printing medium, wherein the image fixing apparatus includes a pressing roller arranged to rotate, a fixing belt including a load support member disposed to rotate about an axial direction and arranged in an axial direction, a heating layer formed on an outer circumferential surface of the load support member to generate heat by receiving electric energy, an electrode layer having at least one portion surrounded by the heating layer at an end of the load support member and arranged to contact a power supply brush to transmit electric energy to the heating layer, a release layer arranged on an outer circumferential surface of the heating layer to contact an outer circumferential surface of the pressing roller, and a rotating bush arranged at opposite ends of the fixing belt to rotatably support the fixing belt and extending a long distance toward an axially central portion of the fixing belt beyond the electrode layer.

In accordance with an aspect of an embodiment, an image fixing apparatus includes a fixing belt disposed to rotate about an axis and provided with a first layer and a second layer disposed inside the first layer to contact the first layer and face the axis of the fixing belt such that a boundary is formed between the first layer and the second layer, a pressing roller disposed to press an outer circumferential surface of the fixing belt to form a fixing nip, and a rotating bush disposed to support an inner circumferential surface of the fixing belt and axially extend toward an inner side of the fixing belt, an inner end of the rotating bush axially extending to an inner portion of the boundary such that the boundary between the first layer and the second layer of the fixing belt is supported by the rotating bush.

An outer end of the pressing roller may axially extend to an outer side of the boundary such that the boundary between the first layer and second layer of the fixing belt is supported by the pressing roller.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
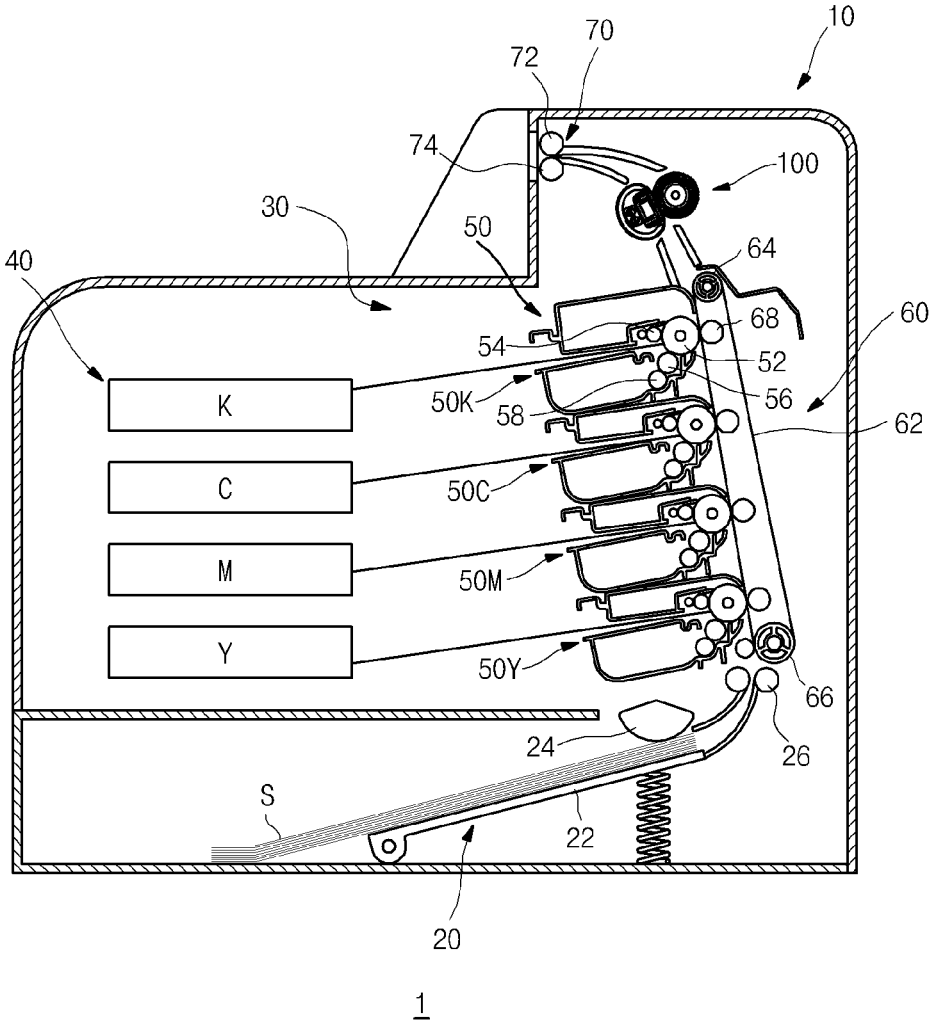
FIG. 1 is a view showing an image forming apparatus according to an exemplary embodiment.

Reference will now be made in detail to the embodiments, examples of which are illustrated in the accompanying drawings, wherein like reference numerals refer to like elements throughout.

As illustrated in FIG. 1, the image forming apparatus 1 includes a body 10, a printing medium feeding unit 20, an image fixing apparatus 100, and a printing medium discharge unit 70.

The body 10 forms an external appearance of the image forming apparatus 1 and may support various components installed therein. The body 10 includes a cover (not shown) that may be arranged to open and close a portion of the body 10, and a body frame (not shown) to support and/or fix various components in the body 10.

The printing medium feeding unit 20 feeds printing media S to a printing unit 30. The printing medium feeding unit 20 includes a tray 22 to stack the printing media S and a pickup roller 24 to pick up the printing media S stacked on the tray 22, for example, one by one. A printing medium picked up by the pickup roller 24 may be transported toward the printing unit 30 by a transport roller 26.

The printing unit 30 may include an optical scanner 40, a developing device 50, and a transfer unit 60.

The optical scanner 40 includes an optical system and projects light corresponding to image information of yellow (Y), magenta (M), cyan (C), and black (K) onto the developing device. According to an embodiment, the image forming apparatus 1 is a color image forming apparatus, and the developing device 50 includes four developing units 50Y, 50M, 50C and 50K in which toner of different colors, e.g., yellow (Y), magenta (M), cyan (C), and black (K), are respectively contained.

Each of the developing units 50Y, 50M, 50C and 50K may include a photosensitive body 52 having a surface on which an electrostatic latent image is formed by the optical scanner 40, a charging roller 54 to charge the photosensitive body 52, a developing roller 56 to supply a toner image to the electrostatic latent image formed on the photosensitive body 52, a feeding roller 58 to feed toner to the developing roller 56.

The transfer unit 60 transfers the toner image formed on the photosensitive body 52 to a printing medium. The transfer unit 60 may include a transfer belt 62 circulating in contact with each photosensitive body 52, a transfer belt driving roller 64 to drive the transfer belt 62, a tension roller 66 to maintain the tension of the transfer belt 62, four transfer rollers 68 to transfer the toner image developed on the photosensitive bodies 52 to a printing medium.

The printing medium may be attached to the transfer belt 62 and transported, for example, at the moving speed of the transfer belt 62. A voltage with a polarity opposite to that of the toner attached to the photosensitive body 52 may be applied to the transfer roller 68. Thereby, the toner image on the photosensitive body 52 may be transferred to the printing medium.

The image fixing apparatus 100 fixes the toner image transferred to the printing medium by the transfer unit 60.

The printing medium discharge unit 70 discharges the printing medium from the body 10. The printing medium discharge unit 70 includes a discharge roller 72 and a pinch roller installed to face the discharge roller 72.

Figure 2:
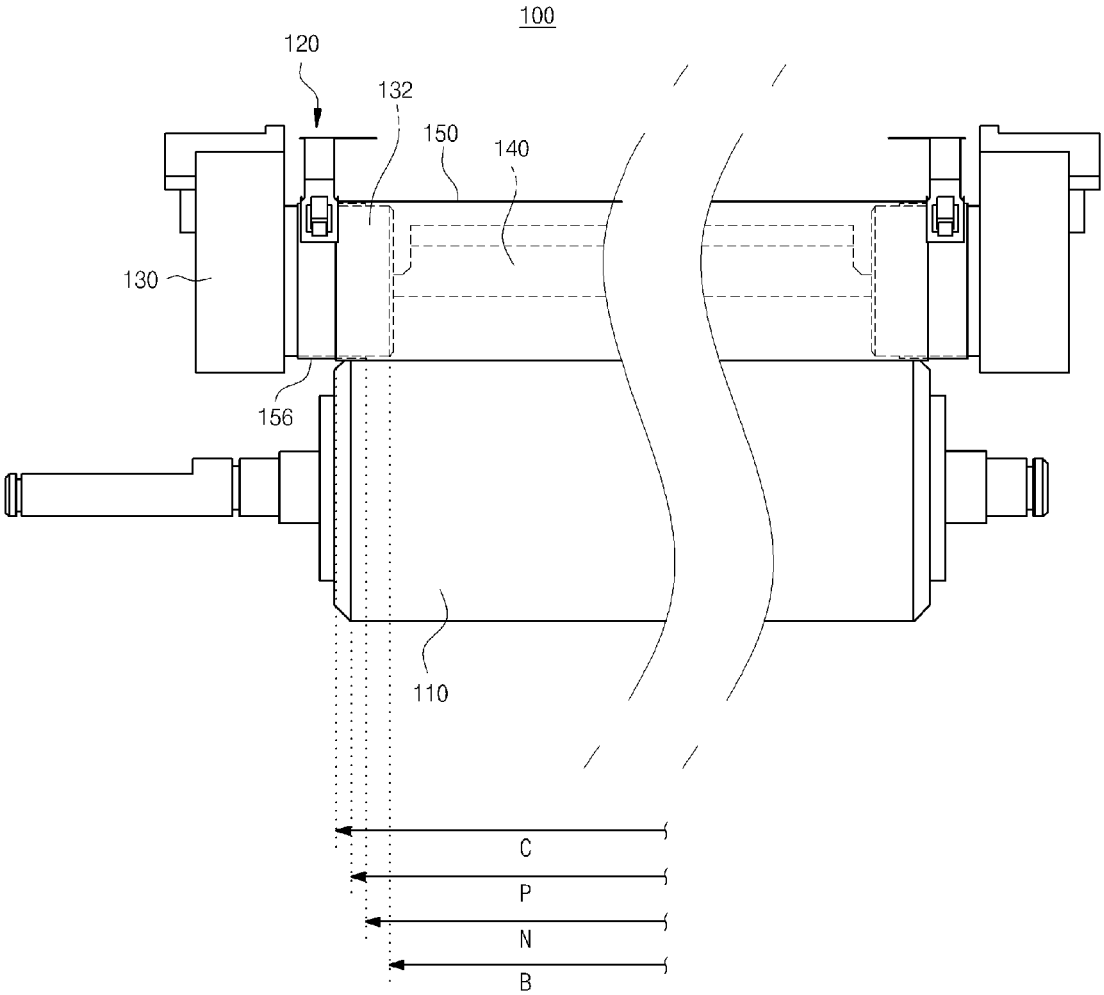
FIG. 2 illustrates an image fixing apparatus according to an embodiment.
Figure 3:
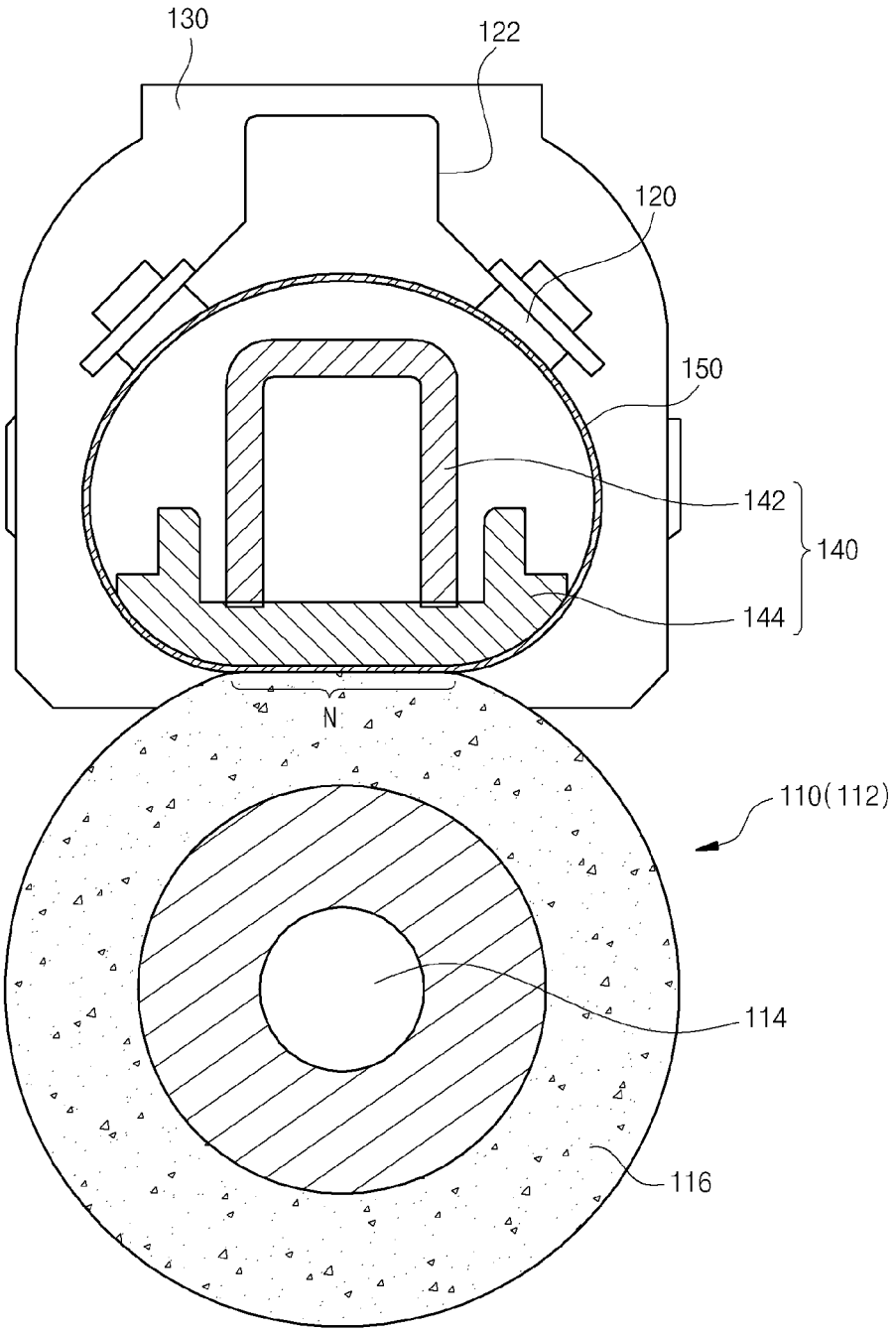
FIG. 3 is a cross-sectional view illustrating an image fixing apparatus according to an embodiment.
Figure 4:
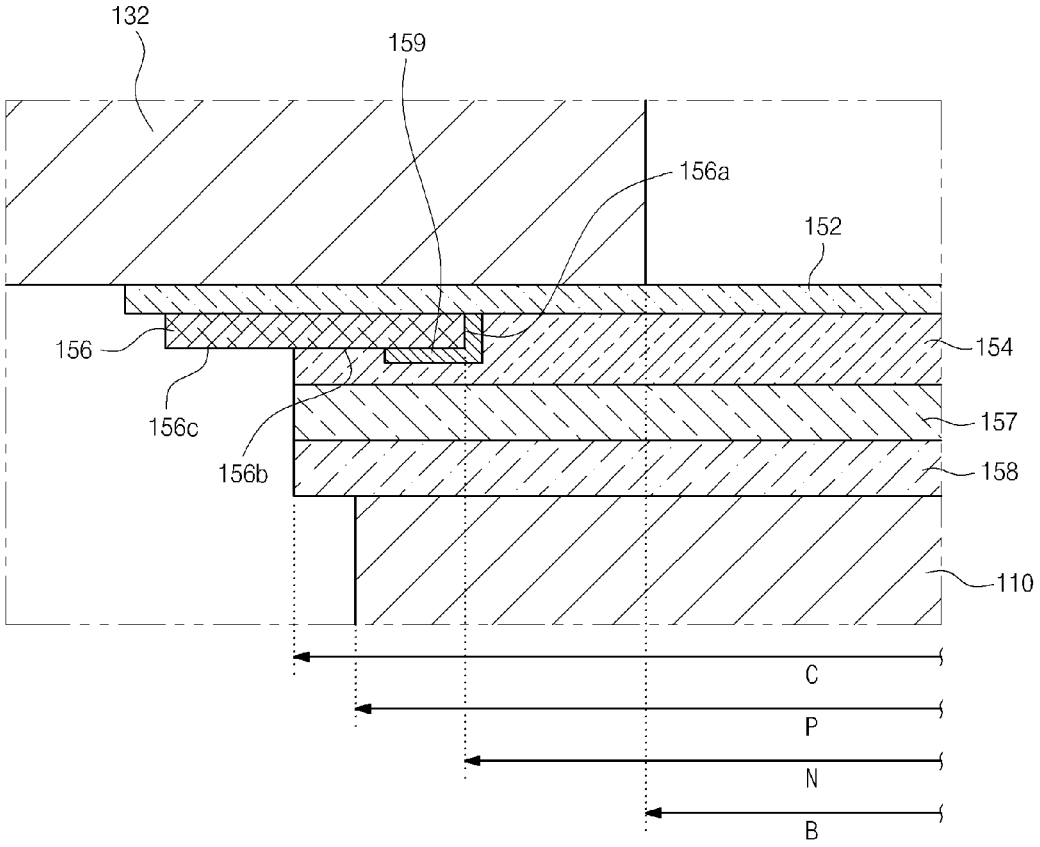
FIG. 4 is a cross-sectional view illustrating a portion of an image fixing apparatus according to an embodiment.

FIG. 2 illustrates an image fixing apparatus according to an embodiment, FIG. 3 is a cross-sectional view illustrating an image fixing apparatus according an embodiment, and FIG. 4 is a cross-sectional view illustrating a portion of an image fixing apparatus according to an embodiment.

The printing medium having the transferred toner image passes through the gap between the pressing roller 110 of the image fixing apparatus 100 and the fixing belt. The toner image may be fixed, for example, at this time to the printing medium, for example, by heat and pressure.

The image fixing apparatus 100 may include a pressing roller 110, a fixing belt, a power supply brush, and a support member 130.

The pressing roller 110 may be disposed to contact the outer circumferential surface of the fixing belt. Thereby, a fixing nip N may be formed between the pressing roller 110 and the fixing belt. The pressing roller 110 may be provided with a fixing roller 112 rotated by power transmitted from a driving source.

The fixing roller 112 includes a shaft 114, which may be formed, for example, of a metallic material such as aluminum or steel, and an elastic roller layer 116 elastically deformed such that a fixing nip may be formed between the elastic roller layer 116 and the fixing belt. The elastic roller layer 116 may be formed, for example, of silicone rubber.

The fixing belt 150 may be engaged with the fixing roller when rotating, and forms the fixing nip in conjunction with the fixing roller 112. When heated by a heating layer 154, the fixing belt 150 transfers heat to a printing medium passing through the fixing nip.

Support members 130 may be disposed at opposite ends of the fixing belt 150. The support members 130 may support components configuring the image fixing apparatus 100. The fixing belt 150 may be rotatably supported by the support members 130. Each of the support members 130 may be provided with a rotating bush 132 protruding toward the fixing belt 150 to rotatably support an end of the fixing belt 150.

The rotating bush 132 may be rotatably arranged at the support members 130 and inserted, for example, into a hollow portion of the fixing belt 150 to support the fixing belt 150 such that that fixing belt 150 is rotatable.

The pressing member 140 applies pressure to the inner circumferential surface of the fixing belt 150 such that the fixing nip N may be formed, for example, between the fixing belt 150 and the pressing roller 110. The pressing member 140 may be formed of a material having a high rigidity, for example, such as stainless steel and/or carbon steel.

The pressing member 140 may include an inner bracket 142 to press the arc-shaped fixing belt 150 against the pressing roller 110, and an inner holder 144 arranged at the lower end of the inner bracket 142 and adapted to contact the inner surface of the fixing belt 150 facing the pressing roller 110 to form a planar fixing nip N. The inner holder 144 may be formed, for example, of a molding material.

The fixing belt 150 may include a load support member 152, a heating layer 154, an electrode layer 156, and a release layer 158.

The load support member 152 may be formed, for example, in the shape of a cylinder having a hollow portion and arranged on the inner surface of the fixing belt 150 to support respective constituents of the fixing belt 150. The rotating bush 132 of the support member 130 may be inserted into the hollow portion of the load support member 152.

The load support member 152 may be, for example, a metal film, e.g., a stainless steel film. A polymer material having a high thermal resistance and a high rigidity may be used for the load support member 152. The thickness of the load support member 152 may be selected to provide a flexibility allowing the load support member 152 to be flexibly deformed at the fixing nip N and recover the original shape thereof upon leaving the fixing nip N.

The heating layer 154 may be arranged to cover the outer circumferential surface of the load support member 152. The heating layer 154 functions to generate heat when electric energy is supplied from the electrode layer 156.

The heating layer 154 may be configured with a carbon nanotube (CNT). CNT is a nanomaterial having excellent mechanical rigidity, thermal conductivity, and chemical stability. CNT has a very low heat capacity per unit volume, for example, about 0.9 $J/cm^3 \cdot K$, compared to that of other conductive filler materials such as stainless steel, whose heat capacity per unit volume is about 3.6 $J/cm^3 \cdot K$, and has a very high thermal conductivity equal to, or higher than 3,000 W/m·K. Accordingly, the CNT may have a greater efficiency in an increase of temperature than other conductive filler materials.

The CNT may be configured with at least one selected from a group of CNT fiber, CNT yarn, CNT textile, CNT sheet, and combinations thereof.

The electrode layer 156 externally receives electric energy through the power supply brush 120 and transfers the same energy to the heating layer 156, which functions as a resistance heater. The electrode layer 156 may be arranged at an axial end of the load support member 152 to surround at least one portion of the outer circumferential surface of the load support member 152.

The electrode layer 156 may be configured as a conductive layer including copper and nickel, and the thickness thereof may be between 5 μm and 40 μm. The electrode layer 156 may adjoin an end of the heating layer 154, and at least one portion thereof may be surrounded by the heating layer 154. A portion of the electrode layer 156 contacting the heating layer 154 in an axial direction may be defined as a first portion **156*a*. At least one portion of the axially central part of the electrode layer 156 whose outer circumferential surface is surrounded by the heating layer 154 may be defined as a second portion 156*b*. A first portion 156*a* and a second portion 156*b* may be adjoined, for example, by a material, e.g., an Ag paste 159 to reduce contact resistance between the heating layer 154 and the electrode layer 156. The first portion 156*a* and at least one part of the second portion 156*b* may adjoin the heating layer 154 via the Ag paste 159. Primer may be applied, for example, to a remaining part of the second portion 156*b* other than the at least one part to improve adhesive bond strength between the electrode layer 156 and the heating layer 154**.

The electrode layer 156 may be arranged such that the first portion **156*a* and the second portion 156*b* contact, or are surrounded by, the heating layer 154. A third portion 156*c* of the electrode layer 156, which is exposed rather than being surround by the heating layer 154, may contact the power supply bush 120** to receive electric energy.

The power supply brush 120 may have at least two contact points at the second portion **156*b* of the electrode layer 156, thereby functioning to supply electric energy to the electrode layer 156. The power supply brush 120 may be pressed against, or caused to closely contact, the electrode layer 156 by an elastic member 122. The elastic member 122** may be a leaf spring. The electric energy may include alternating current (AC).

The outermost surface of the fixing belt 150 may include a release layer 158. The release layer 158 prevents toner melted by heat from adhering to the fixing belt 150, thereby allowing a printing medium having passed through the fixing nip to be easily separated from the fixing belt 150.

The release layer 158 may directly surround the outer circumferential surface of the heating layer 154, or may surround the outer circumferential surface of the heating layer 154 with an elastic layer 157, interposed between the release layer 158 and the heating layer 154.

A surface of the printing medium having an adhered toner image contacts the fixing belt 150. An opposite surface of the printing medium may be supported by the pressing roller 110.

When electric energy is supplied to the heating layer 154, the temperature of the fixing belt 150 may rise to a temperature necessary for the fixing operation, e.g., a temperature between 150° C. and 200° C. The toner on the printing medium may be melted by the thermal energy of the heating layer 154. The melted toner may be pressed on the surface of the printing medium by the pressure applied by the fixing belt 150 and the pressing roller 110, which may be engaged with each other. Thereby, the toner image is fixed to the printing medium.

A material of the release layer 158, for example, a polymer, may have a release property allowing the toner to be stably fixed to a sheet of paper when subjected to heat and pressure and does not cause toner offset.

To improve heat transfer, the release layer 158 may include a conductive filler such as a metal-based filler, a carbon-based filler, or a metal oxide-based filler. The release layer 158 may be constructed with a material, for example, having excellent heat transfer and release properties.

The fixing belt 150 may include an elastic layer 157 having high thermal conductivity and elasticity. The elastic layer 157 may be arranged between the release layer 158 and the heating layer 154. The elastic layer 157 may include liquid silicone rubber (LSR).

The respective layers configuring the fixing belt 150 may be adhered to each other by a primer (not shown) to increase contact force.

Exemplary relationships between constituents according to a configuration are disclosed The fixing nip N may be formed between the fixing belt 150 and the pressing roller 110 by the pressing roller 110 and the pressing member 140. Since the fixing nip N may be formed only within the axial length of the pressing roller 110 and the power supply brush 120 presses the fixing belt 150, the fixing nip may have a different shape at a central portion and an end portion of the fixing belt 150 in the axial direction.

Since the central portion and the end portion of the fixing belt 150 may be subject to different forces, a possibility of fatigue failure of portions of the heating layer 154 and the electrode layer 156 connected to each other may increase.

An end of the rotating bush 132 may be elongated toward the axially central portion of the fixing belt 150 to inwardly support the first portion 156*a* through which the electrode layer 156 and the heating layer 154 contact each other, thereby enhancing durability of the portions of the electrode layer 156 and the heating layer 154 contacting each other in the axial direction.

A pressing roller 110 may be elongated in an axial direction to guide the first portion 156*a*, through which the electrode layer 156 and the heating layer 154 contact each other, in the direction of an outer diameter, thereby preventing the trajectory of the first portion 156*a* from escaping from the trajectory of the pressing roller 110. Thereby, heat generated in the heating layer 154 may be moved toward the pressing roller 110, preventing overheat of the fixing belt 150. Accordingly, local breakage resulting from deterioration of the first portion 156*a* through which the electrode layer 156 and the heating layer 154 contact or the second portion 156*b* may be prevented.

A first portion 156*a* through which the electrode layer 156 and the heating layer 154 contact each other may be inwardly supported by the rotating bush 132 and supported by the pressing roller 110 in the direction of the outer diameter thereof, thereby preventing fatigue failure of a member arranged to contact the first portion 156*a* and formed of a different material.

Since the first portion 156*a*, which is arranged inside the release layer 158 contacting the pressing roller 110, is guided in the inward direction and the direction of the outer diameter thereof by the rotating bush 132 and the pressing roller 110, deformation of the fixing nip N extending from the central portion of the fixing belt 150 to the ends of the fixing belt 150 may be prevented.

The axial length of the pressing roller 110 may be greater than the length of axial contact between the electrode layer 156 and the heating layer 154 and less than the length of the heating layer 154.

Since the heating layer 154 functions as a resistance heater by receiving electric energy from the electrode layer 156, the pressing roller 110 may be formed to be shorter than the heating layer 154 to secure an insulation distance. An end of the heating layer 154 may be longer than an end of the pressing roller 110 with respect to the axial central portion of the fixing belt 150, for example, by 4 mm or more.

When a distance from the axially central portion of the fixing belt 150 to an end of the heating layer 154 is "C", a distance from the axially central portion of the fixing belt 150 to an end of the pressing roller 110 is "P", a distance from the axially central portion of the fixing belt 150 to the portions of the electrode layer 156 and the heating layer 154 axially contacting each other is "N", and a distance from the axially central portion of fixing belt 150 to an end of the rotating bush 132 is "B", the relation of Equation 1 may be satisfied $$C>P>N>B \qquad \text{Equation 1}$$

Another embodiment is described below.

An image fixing apparatus may include a fixing belt disposed to rotate about an axis and provided with a first layer and a second layer disposed inside the first layer to contact the first layer and face the axis of the fixing belt such that a boundary is formed between the first layer and the second layer. A pressing roller may be disposed to press the outer circumferential surface of the fixing belt to form a fixing nip. A rotating bush may be disposed to support the inner circumferential surface of the fixing belt and axially extend toward the inner side of the fixing belt. The inner end of the rotating bush may axially extend to the inner portion of the boundary such that the boundary between the first layer and the second layer is supported by the rotating bush.

The first layer may be an electrode layer. The second layer may be a heating layer.

The outer end of the pressing roller may axially extend to an outer side of the boundary such that the boundary between the first and second layers of the fixing belt is supported by the pressing roller.

As the image fixing apparatus is configured such that the fixing belt 150 is heated by heat produced in the heating layer 154 without a separate heating element, durability of the portions of the heating layer 154 and the electrode layer 156 connected to each other may be enhanced and safe supply of electric energy may be ensured. Overheating of the connected portions may be prevented, and accordingly local damage resulting from heat may be prevented.

As is apparent from the above description, with an image fixing apparatus according to an embodiment, a uniform fixing nip may be formed and maintained, durability of the portions of the heating layer and electrode layer of a fixing belt connected to each other may be enhanced.

Overheating of the connected portions may be prevented, and accordingly local damage resulting from heat may be prevented.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An image fixing apparatus comprising:

a pressing roller arranged to rotate;

a fixing belt arranged to rotate about an axis and disposed such that an outer circumferential surface of the fixing belt contacts the pressing roller; and a rotating bush arranged at opposite ends of the fixing belt to support rotation of the fixing belt, wherein the fixing belt comprises:

a load support member arranged in an axial direction, a heating layer formed on at least one portion of an outer circumferential surface of the load support member to generate heat by receiving electric energy, and an electrode layer provided with a first portion axially contacting an end of the heating layer at an axial end of the load support member, the electrode layer transferring electric energy to the heating layer, wherein an inner end of the rotating bush axially extends to an inner side of the electrode layer such that the electrode layer is supported by the rotating bush.

2. The image fixing apparatus according to claim 1, wherein the inner end of the rotating bush axially extends to an inner side of the first portion such that the first portion is supported by the rotating bush.

3. The image fixing apparatus according to claim 1, wherein an end of the pressing roller axially extends to an outer side of the first portion such that the first portion is supported by the pressing roller.

4. The image fixing apparatus according to claim 3, wherein the pressing roller extends a shorter length from an axially central portion of the fixing belt toward ends of the fixing belt than the heating layer.

5. The image fixing apparatus according to claim 4, wherein a distance between an end of the pressing roller and a corresponding end of the heating layer in an axial direction of the fixing belt is equal to or greater than 4 mm.

6. The image fixing apparatus according to claim 1, wherein the heating layer surrounds a second portion forming at least one portion of an outer circumferential surface of the electrode layer.

7. The image fixing apparatus according to claim 6, wherein the first portion and at least one part of the second portion of the electrode layer is allowed to contact the heating layer by Ag paste.

8. The image fixing apparatus according to claim 6, wherein a third portion of the electrode layer rather than the first portion and the second portion does not contact the heating layer, but contacts a power supply brush to transfer electric energy to the heating layer.

9. The image fixing apparatus according to claim 1, wherein the fixing belt further comprises a release layer arranged on an outer circumferential surface of the heating layer to contact the pressing roller.

10. The image fixing apparatus according to claim 1, wherein the heating layer comprises a carbon nanotube.

11. An image fixing apparatus comprising:

a pressing roller arranged to rotate;

a fixing belt having a hollow portion and disposed such that an outer circumferential surface of the fixing belt contacts the pressing roller; and a rotating bush having at least one part inserted into the hollow portion and adapted to support rotation of the fixing belt, wherein the fixing belt comprises:

a load support member having an axial hollow portion, a heating layer formed on at least one part of an outer circumferential surface of the load support member to generate heat when receiving electric energy supplied thereto, an electrode layer provided with a first portion axially contacting the heating layer at an axial end of the load support member and a second portion forming at least one part of an outer circumferential surface of the electrode layer and surrounded by heating layer, the electrode layer transferring electric energy to the heating layer, wherein a distance (C) from an axially central portion of the fixing belt to an end of the heating layer, a distance (P) from the axially central portion of the fixing belt to an end of the pressing roller, a distance (N) from the axially central portion of the fixing belt to the first portion, and a distance (B) from the axially central portion of the fixing belt to an end of the rotating bush satisfy a relationship of C>P>N>B.

12. The image firing apparatus according to claim 11, wherein the fixing belt further comprises a release layer arranged on an outermost surface of the fixing belt and disposed to contact the pressing roller.

13. The image fixing apparatus according to claim 11, wherein the heating layer comprises a carbon nanotube.

14. The image fixing apparatus according to claim 11, wherein the electrode layer contacts a power supply brush externally supplying electric energy and comprises a third portion, an outer circumferential surface of the third portion being exposed to an outside of the outer circumferential surface.

15. The image fixing apparatus according to claim 11, wherein the distance (C) from the axially central portion of the fixing belt to the end of the heating layer is greater than the distance (P) from the axially central portion of the fixing belt to the end of the pressing roller by 4 mm or more.

16. An image forming apparatus comprising:

a printing unit to form an image on a printing medium; and a fixing apparatus to fix the image to the printing medium, wherein the fixing apparatus comprises:

a pressing roller arranged to rotate;

a fixing belt comprising a load support member disposed to rotate about an axial direction and arranged in an axial direction, a heating layer formed on an outer circumferential surface of the load support member to generate heat by receiving electric energy, an electrode layer having at least one portion surrounded by the heating layer at an end of the load support member and arranged to contact a power supply brush to transmit electric energy to the heating layer, a release layer arranged on an outer circumferential surface of the heating layer to contact an outer circumferential surface of the pressing roller, and a rotating bush arranged at opposite ends of the fixing belt to rotatably support the fixing belt and extending a long distance toward an axially central portion of the fixing belt beyond the electrode layer.

17. An image fixing apparatus comprising:

a fixing belt disposed to rotate about an axis and provided with a first layer and a second layer disposed inside the first layer to contact the first layer and face the axis of the fixing belt such that a boundary is formed between the first layer and the second layer;

a pressing roller disposed to press an outer circumferential surface of the fixing belt to form a fixing nip; and a rotating bush disposed to support an inner circumferential surface of the fixing belt and axially extend toward an inner side of the fixing belt, an inner end of the rotating bush axially extending to an inner portion of the boundary such that the boundary between the first layer and the second layer of the fixing belt is supported by the rotating bush, wherein an outer end of the pressing roller axially extends to an outer side of the boundary such that the boundary between the first layer and second layer of the fixing belt is supported by the pressing roller.

* * * * *